US006896166B2

(12) United States Patent
Byard

(10) Patent No.: US 6,896,166 B2
(45) Date of Patent: May 24, 2005

(54) HAMMER-OPERATED STAPLING APPARATUS

(76) Inventor: Kenneth L. Byard, 715 East Ave. A, Hutchinson, KS (US) 67501

( * ) Notice: Subject to any disclaimer, the term of this patent is extended or adjusted under 35 U.S.C. 154(b) by 0 days.

(21) Appl. No.: 10/632,378

(22) Filed: Aug. 1, 2003

(65) Prior Publication Data

US 2005/0023322 A1 Feb. 3, 2005

(51) Int. Cl.[7] ..... B25C 5/02
(52) U.S. Cl. ..... 227/129; 227/120
(58) Field of Search ..... 227/129, 109, 227/120

(56) References Cited

U.S. PATENT DOCUMENTS

| | | | | | |
|---|---|---|---|---|---|
| 2,311,412 | A | | 2/1943 | Pankonin | 1/3 |
| 2,343,203 | A | | 2/1944 | Pankonin | 1/3 |
| 2,618,779 | A | | 11/1952 | Byard | 1/49 |
| 3,272,417 | A | * | 9/1966 | Langas et al. | 227/123 |
| 4,087,035 | A | | 5/1978 | Harmon | 227/120 |
| 4,184,622 | A | * | 1/1980 | Spehrley, Jr. | 227/119 |
| 4,206,863 | A | * | 6/1980 | Savino | 227/83 |
| 4,380,312 | A | * | 4/1983 | Landrus | 227/116 |
| 4,450,998 | A | * | 5/1984 | Ruskin | 227/8 |
| 4,552,296 | A | | 11/1985 | Sheng | 227/109 |
| 5,699,864 | A | * | 12/1997 | Dvorak et al. | 173/91 |
| 5,813,588 | A | * | 9/1998 | Lin | 227/109 |
| 5,941,441 | A | * | 8/1999 | Ilagan | 227/131 |
| 6,550,660 | B1 | | 4/2003 | Chlebowski et al. | 227/133 |

* cited by examiner

*Primary Examiner*—Louis K. Huynh
*Assistant Examiner*—Gloria R. Weeks
(74) *Attorney, Agent, or Firm*—John M. Harrison

(57) ABSTRACT

A hammer-operated stapling apparatus which is characterized by a spring-loaded plunger having a staple drive plate that slidably extends between a front head and a back head to sequentially contact staples seated in a staple magazine attached to the back head. The staple magazine is closed by a pivoting cover fitted with a removable spacer and includes removable staple rails for accommodating staples of various size, which staple rails are fitted with a sliding follower biased against the staple string or cartridge by a follower spring seated on the staple rail. A handle is mounted to the front head and back head assembly and typically includes a hand guard for safely positioning the ends of the front head and back head on a wire or other element to be stapled to a post or board and facilitating striking of the plunger by the hammer to drive a staple into the board or post and secure the wire or element in place.

4 Claims, 7 Drawing Sheets

HAMMER-OPERATED STAPLING APPARATUS

CROSS-REFERENCE TO RELATED APPLICATIONS

This application relates to my copending U.S. Design patent application Ser. No. 29,169,792, Filed Oct. 28, 2002.

SUMMARY OF THE INVENTION

The hammer-operated stapling apparatus of this invention is characterized by a spring-loaded, hammer-driven plunger having a staple drive plate that slidably extends between a front head and a back head to sequentially contact a string of staples seated on a staple rail in a staple magazine attached to the back head. The staple magazine receives a pivoting magazine cover which may be fitted with one of several removable spacers of selected thickness to mount removable staple rails for accommodating staples of various size. The respective rails are each fitted with a sliding, spring-loaded follower for applying tension to a staple string or cartridge slidably seated on the rail. In a preferred embodiment the staples are glued together in a cartridge and are sequentially guided along the staple rail into a staple staging space between the front head and the back head, for engagement by the staple drive plate when the plunger is struck by a hammer. A handle is mounted to the front head and back head assembly and includes a hand guard for safely positioning the notched ends of the front head and back head on a wire or other element to be stapled to a post or board and facilitating striking of the plunger by a hammer to drive each staple in sequence from the staple staging space into the board or post and secure the wire or element in place.

DESCRIPTION OF THE PREFERRED EMBODIMENTS

Figure 1:
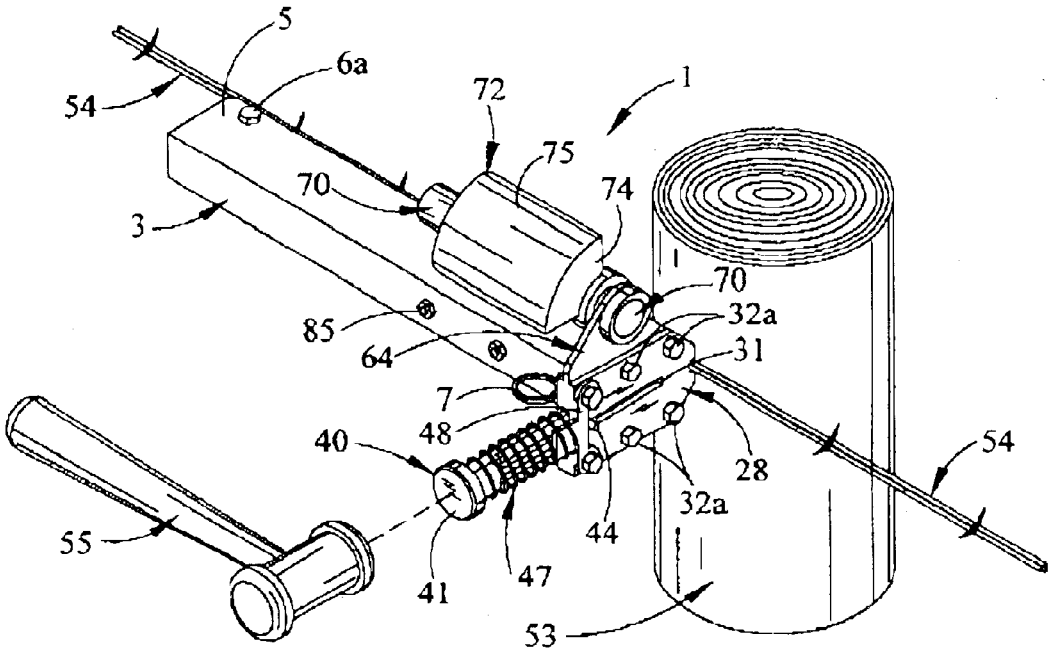
FIG. 1 is a perspective view of the hammer-operated stapling apparatus fitted against a length of wire to be stapled to a post and indicating a typical hammer position for operating the stapling apparatus.
Figure 2:
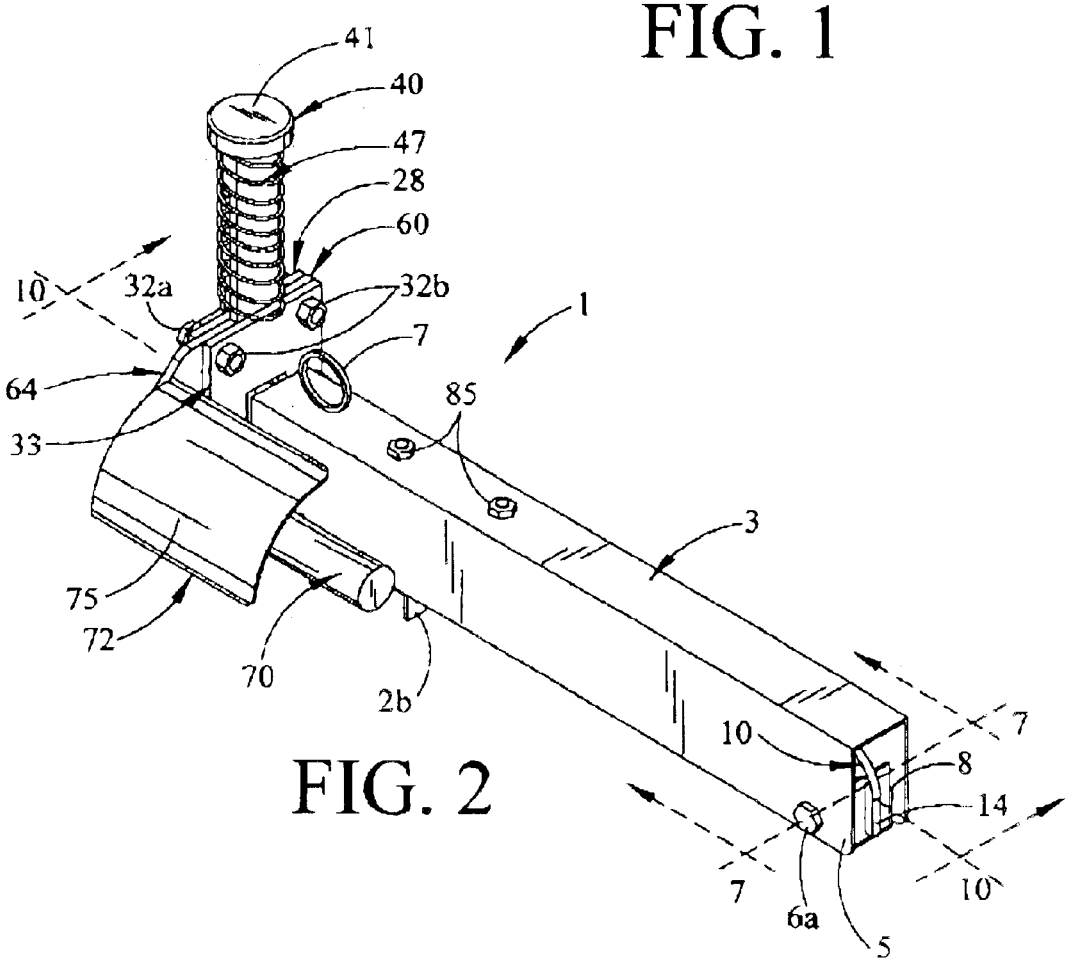
FIG. 2 is a rear perspective view of the stapling apparatus illustrated in FIG. 1.
Figure 3:
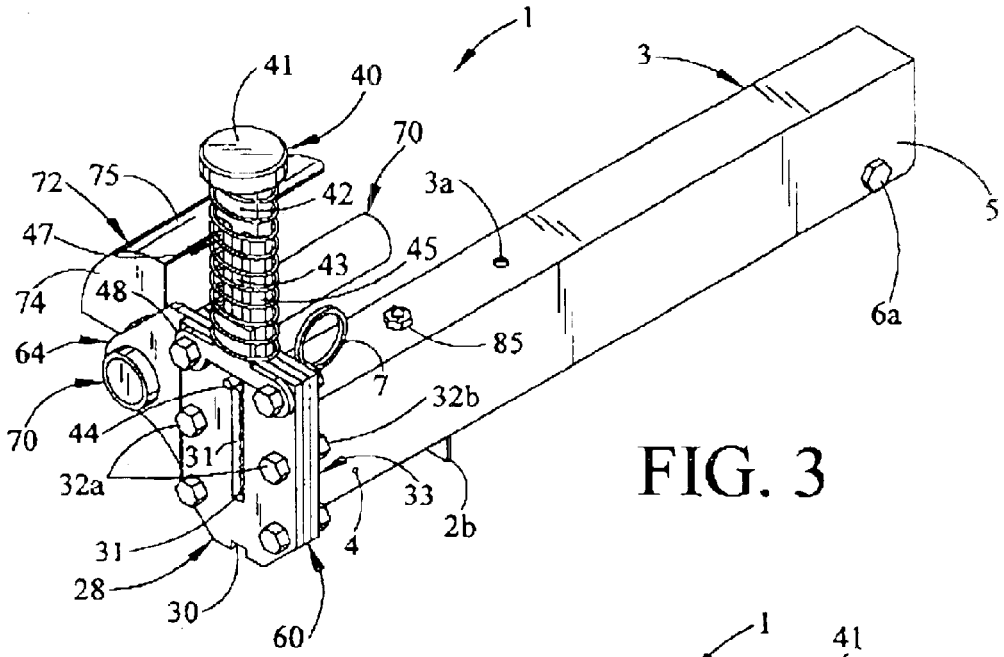
FIG. 3 is a front perspective view of the stapling apparatus illustrated in FIGS. 1 and 2.
Figure 4:
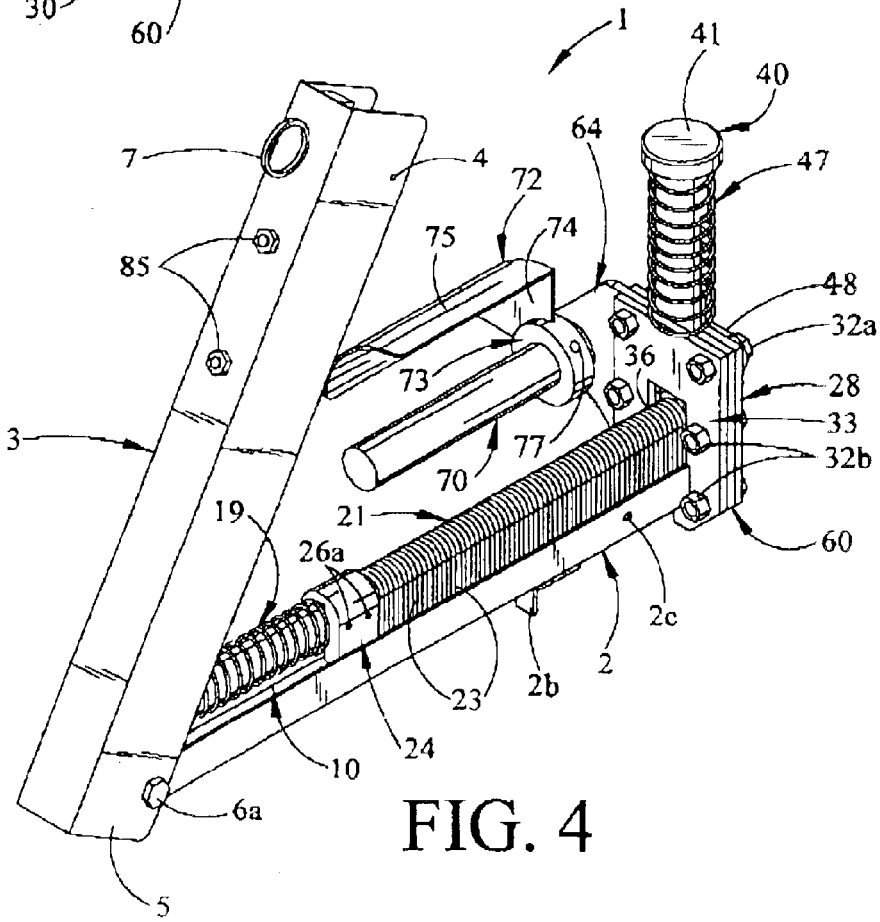
FIG. 4 is a rear perspective view of the stapling apparatus illustrated in FIGS. 1 through 3, with the magazine cover pivoted upwardly to facilitate loading a string or cartridge of staples on the staple rail in the staple magazine of the stapling apparatus.
Figure 12:
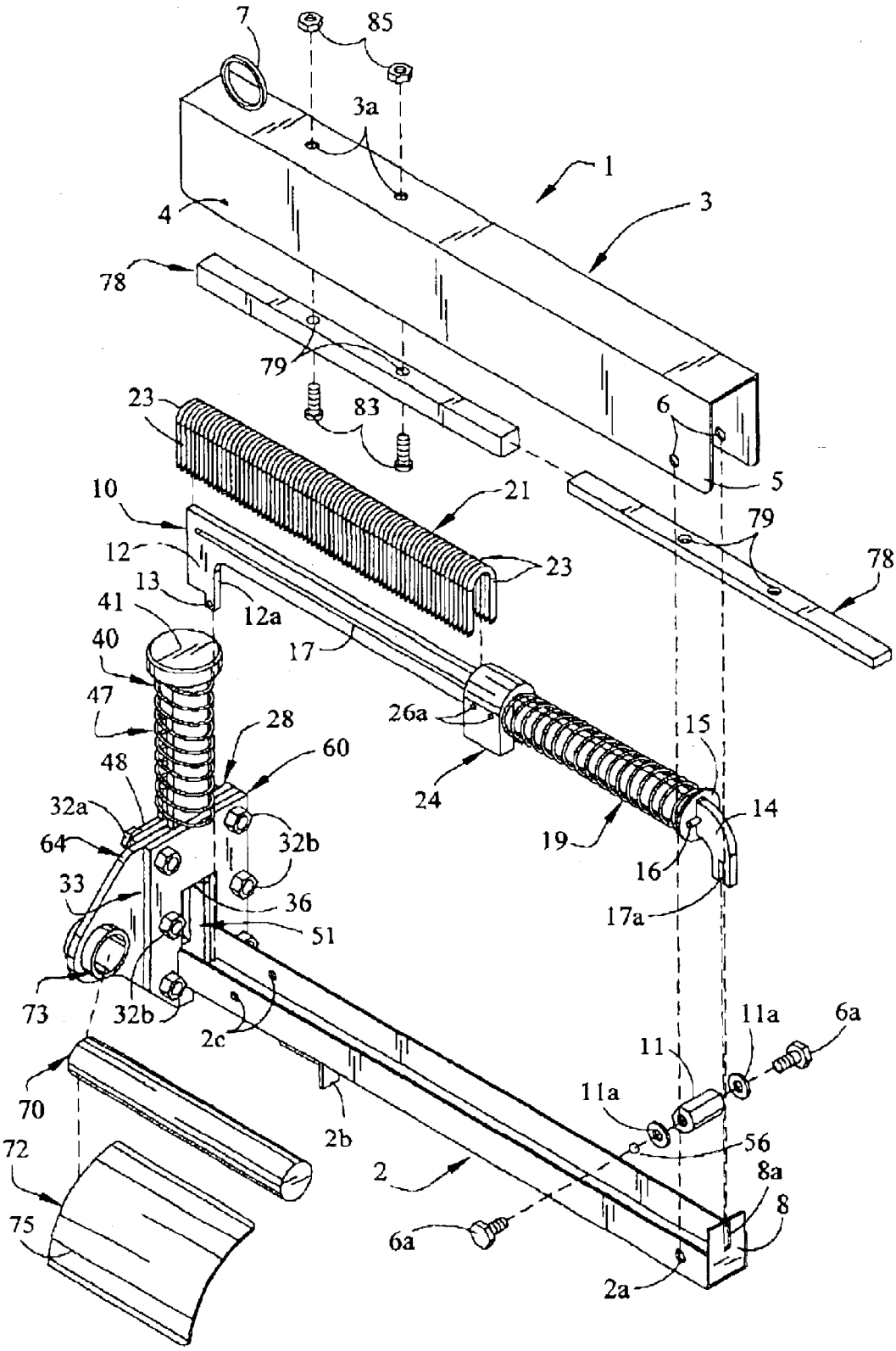
FIG. 12 is an exploded view of the stapling apparatus illustrated in FIG. 2.

Referring initially to FIGS. 1–4, 8 and 12 of the drawings the hammer-operated stapling apparatus of this invention is generally illustrated by reference numeral 1. In a preferred embodiment the hammer operated stapling apparatus 1 is characterized by a generally channel-shaped staple magazine 2, having one end welded to a back head 33 and fitted with a pivotally-mounted magazine cover 3. A pair of oppositely-disposed cover dimples 4, provided in the magazine cover 4, correspond with a pair of oppositely-disposed dimple seats 2*c*, located in the staple magazine 2 (FIG. 4) to facilitate a friction-fit when pivotally closing the magazine cover 3 on the staple magazine 2 at a cover hinge 5. An L-shaped, slotted cover stop 2*b* is welded or otherwise provided on the bottom of the staple magazine 2 to engage the parallel edges of the magazine cover 3 when it is closed on the staple magazine 2, as illustrated in FIGS. 3 and 4. The cover hinge 5 is typically characterized by a cover hinge bolt opening 6 in the magazine cover 3 and a corresponding registering pivot bolt opening 2*a* in the staple magazine 2, to accommodate a pair of cover hinge bolts 6*a*, threaded through cover spacer washers 11*a* into a cover spacer 11, against a ball bearing or BB 56, as illustrated in FIG. 12. A cover ring 7 is typically welded or otherwise secured to the top of the magazine cover 3 to facilitate easy grasping and pivoting of the magazine cover 3 on the staple magazine 2 at the cover hinge bolts 6*a*, to facilitate access to the staple magazine 2. A staple rail anchor 8, having an anchor slot 8*a*, is upward-standing on the extending or distal end of the staple magazine 2 rearwardly of the pivot pin opening 2*a* and an anchor opening 9 (FIG. 8) is provided in the bottom of the staple magazine 2 near the back head 33.

Figure 13:
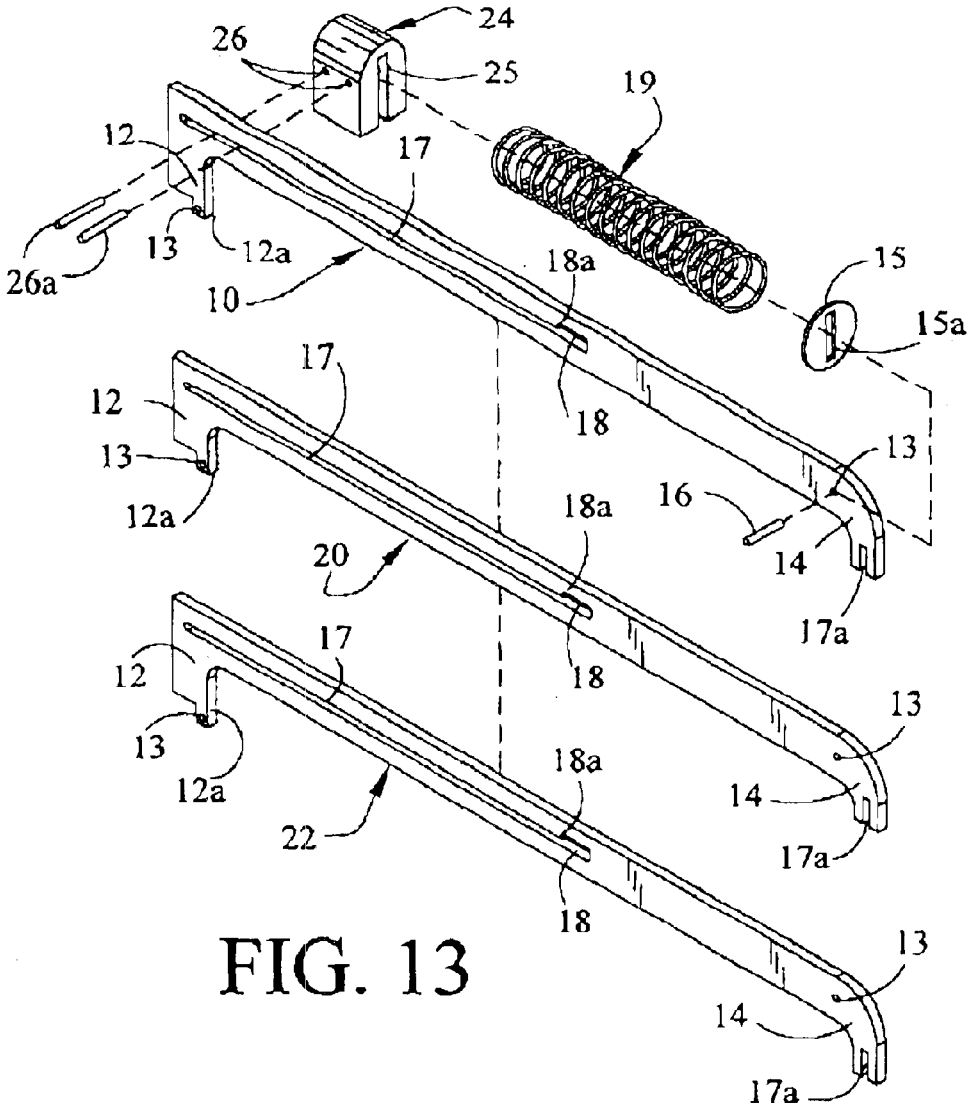
FIG. 13 is a perspective view of three staple rails of varying size for accommodating staples of various size in the stapling apparatus.

As illustrated in FIGS. 9–13, the staple rail anchor 8 is designed to engage a leg slot 17*a*, provided in the downwardly-extending rear rail leg 14 of a first staple rail 10, preferably at an anchor slot 8*a* (FIG. 12). The first staple rail 10 is also provided with a downwardly-extending front rail leg 12, terminated by a leg anchor 12*a*, designed to match and extend through the corresponding anchor opening 9 in the bottom of the staple magazine 2 and receive an anchor roll pin 13*a*, that extends through a roll pin opening 13 provided in the front rail leg 12, as illustrated. Accordingly, when the anchor roll pin 13*a* is seated in the leg anchor 12*a* against the bottom of the staple magazine 2 and the staple rail anchor 8 extends into the leg slot 17*a* of the rear rail leg 14, preferably at an anchor slot 8*a*, the first staple rail 10 is securely, yet removably mounted on the staple magazine 2. A spring retainer 15, having a vertical spring retainer slot 15*a* (FIG. 13), is mounted on the extending end of the first staple rail 10 at the point where the rear rail leg 14 extends downwardly and is typically secured in place by means of a spring retainer roll pin 16, fitted in a transverse roll pin opening 13 in the first staple rail 10. Accordingly, it will be appreciated from a consideration of FIGS. 9–12 that the first staple rail 10 can be removably mounted in the staple magazine 2 by interlocking the staple rail anchor slot 8*a* in the anchor 8 with the corresponding leg slot 17*a* to secure the rear rail leg 14 in place, extending the leg anchor 12*a* through the corresponding anchor opening 9 in the bottom of the staple magazine 2 and projecting an anchor roll pin 13*a* through the corresponding roll pin opening 13. Consequently, a first staple rail 10, a second staple rail 20 and a third staple rail 22, illustrated in FIGS. 9–11 and 13, can be alternatively and removably seated in the staple magazine 2 in this manner to accommodate staples of different size, since the respective front rail legs 12 and rear rail legs 14 of these staple rails are of different lengths. Furthermore, each of the first staple rail 10, second staple rail 20 and the third staple rail 22 is provided with a longitudinal rail slot 17, extending from the corresponding front rail leg 12. Each rail slot 17 has a slot enlargement 18 located near the middle of the respective staple rails that defines an enlargement shoulder 18*a* therein (FIG. 13). Each rail slot 17 is designed to guide a typically UHMW polyethylene, sliding follower 24, having a follower slot 25 (FIG. 13) that slidably seats on each of the first staple rail 10, second staple rail 20 and third staple rail 22, respectively. A pair of follower roll pins 26*a*, extending transversely through roll pin openings 26 in the follower 24, the follower slot 25, and the rail slot 17, maintain the follower 24 in sliding relationship on the corresponding first staple rail 10, second staple rail 20 or the third staple rail 22. Moreover, as illustrated in FIGS. 9–13 of the drawings a follower spring 19 is seated on the first staple rail 10 between the follower 24 and the spring retainer 15 to bias the follower 24 to the front of the first staple rail 10 above the front rail leg 12 when no staples 23 are loaded in the staple magazine 2. When it is desired to load the staple magazine 2 with a supply of staples 23, preferably glued together in a staple cartridge 21, the follower 24 is initially forced rearwardly against the bias of the follower spring 19 by finger pressure along the first staple rail 10, to the point where upward pressure exerted on the follower 24 allows one of the follower roll pins 26*a* to engage the enlargement shoulder 18*a* in the slot enlargement 18. This action compresses the follower spring 19 and facilitates loading of the staples 23, typically as a staple cartridge 21, on that segment of the first staple rail 10 extending between the back head 33 and the follower 24. The follower 24 is then released by finger pressure from engagement with the enlargement shoulder 18*a* and is seated against the stick or string of staples 23 to bias the staples 23 forwardly on the first staple rail 10 in the staple magazine 2.

Figure 15:
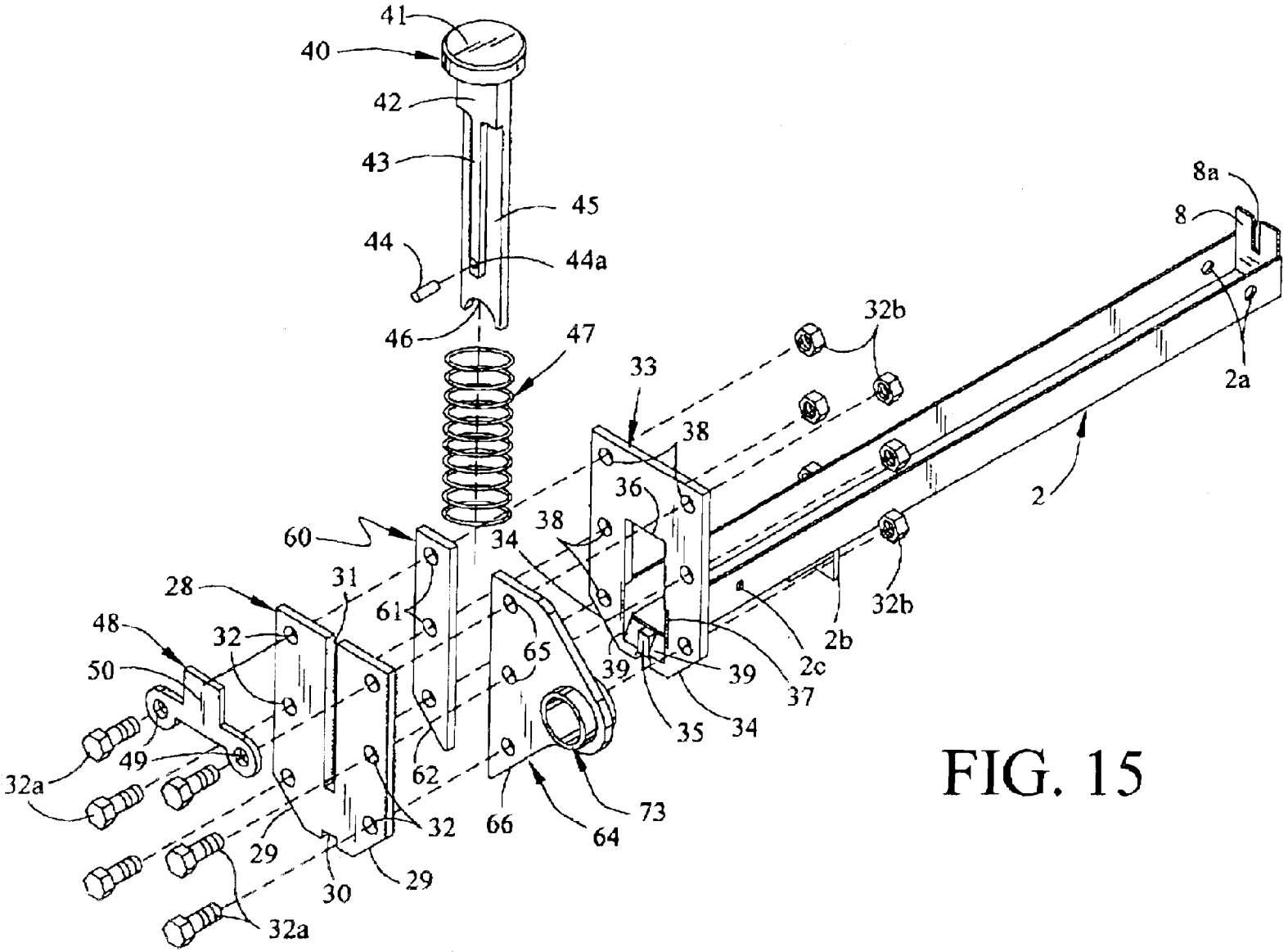
FIG. 15 is an exploded view of a preferred magazine, front head, back head, staple gauge and plunger design for guiding and driving staples in the stapling apparatus of this invention.

Referring now to FIGS. 12 and 15 of the drawings it will be appreciated, as noted above, that the back head 33 is welded or otherwise fixed to the opposite end of the staple magazine 2 from the staple rail anchor 8. The back head 33 is further characterized by a back head bevel 34 provided on each bottom edge, which terminate to define a back head notch 35, and a back head slot 36 is provided vertically in the back head 33 above the back head notch 35, for purposes which will be hereinafter further described. A back head enlargement 37 (FIG. 15) is provided at the bottom of the back head slot 36, to accommodate one end of the staple magazine 2 and facilitate attachment of the staple magazine 2 to the back head 33, typically by welding. A pair of spaced-apart staple point bevels 39 are also shaped in the bottom external face of the back head 33, spanning the back head notch 35, for contacting and guiding the legs of the staples 23 as they are sequentially driven from the back head 33, as further hereinafter described. Spaced-apart and oppositely-disposed back head mount openings 38 are also provided for securing the back head 33 to a similar front head 28 and to an outside staple gauge spacer 60 and an inside staple gauge spacer 64, that are each sandwiched between the front head 28 and the back head 33 and are themselves spaced-apart to define, with the spaced-apart front head 28 and back head 33, a staple staging space 51 (FIGS. 5 and 12) that accommodates the staples 33 in sequence as they are driven therefrom by the plunger 40. The outside staple gauge spacer 60 is provided with outside mount openings 61 and the inside staple gauge spacer 64 includes inside mount openings 65 that correspond to and align with the respective front head mount openings 32 and back head mount openings 38, provided in the front head 28 and the back head 33, respectively. As in the case of the back head 33, the front head 28 is further provided with a front head bevel 29 on both bottom edges, that converge to define a front head notch 30, which further aligns with, and is spaced-apart from the back head notch 35 in the back head 33. The front head 28 also includes a front head slot 31 extending through the top edge thereof, for purposes which will be hereinafter further described.

Accordingly, it will be appreciated from a consideration of FIGS. 3–5, 12 and 15 of the drawings, that when the front head 28 and the back head 33 are assembled on the outside staple gauge spacer 60 and the inside spacer gauge 64, typically using head mount bolts 32*a* that extend through the respective corresponding front head mount openings 32, back head mount openings 38, outside mount openings 61 and inside mount openings 65, secured by nuts 32*b*, the staple staging space 51 is defined for sequentially receiving the respective staples 33 in driving relationship, as further hereinafter described. As in the case of the front head 28 and the back head 33, the outside staple gauge spacer 60 further includes an outside bevel 62 and the inside staple gauge spacer 64 features an inside bevel 66, for matching the respective front head bevel 29 and back head bevel 34 and defining the staple staging space 51. The inside staple gauge spacer 64 is shaped to receive a hand guard shaft collar 73, which further receives and mounts a handle 70. The handle 70 can either be threaded on one end for threadable insertion in a correspondingly internally-threaded hand guard shaft collar 73, or the hand guard shaft collar 33 may be provided with a shaft collar allen screw or bolt 77 (FIG. 4), or both, for tightening the hand guard shaft 73 on the handle 70, as desired. A hand guard 72 is further typically provided on the hand guard shaft collar 73 and includes a hand guard flange 74, which typically mounts the hand guard shaft collar 73, and a curved guard plate 75, that extends from the hand guard flange 74 along the handle 70 to protect the hand when holding the handle 70, positioning the hammer-operated stapling apparatus 1 in functional configuration and operating the hammer-operated stapling apparatus 1, as illustrated in FIG. 1 and hereinafter further described.

Figure 5:
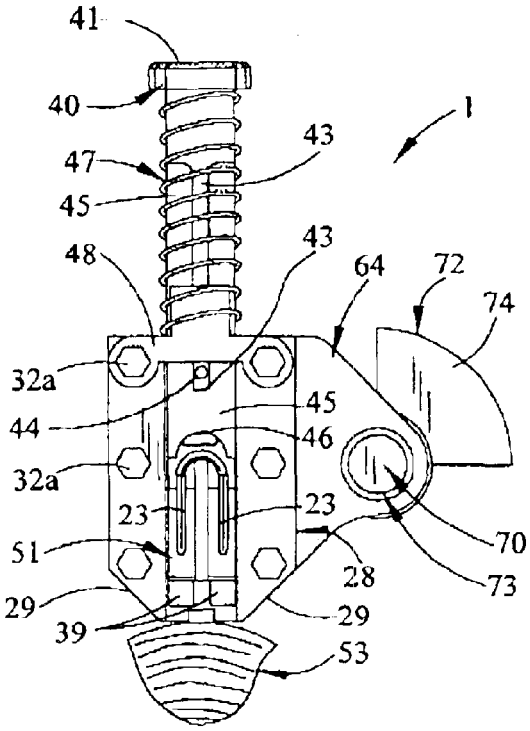
FIG. 5 is a front view of the stapling apparatus in functional configuration positioned against a post for driving a staple into the post.
Figure 6:
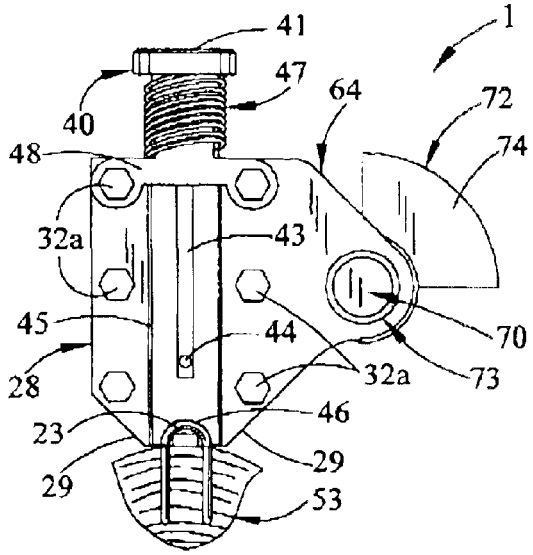
FIG. 6 is a front view of the stapling apparatus illustrated in FIG. 5 after the plunger is struck with a hammer to drive the staple into the post.
Figure 7:
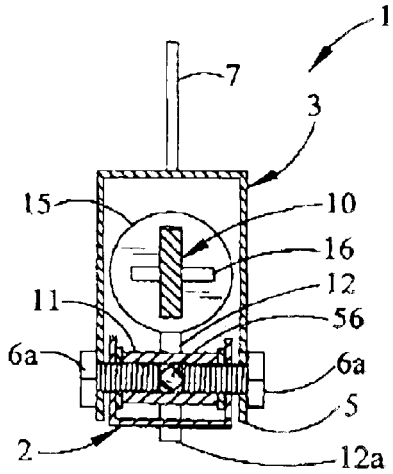
FIG. 7 is a rear sectional view taken along line 7—7 of the stapling apparatus illustrated in FIG. 2.
Figure 8:
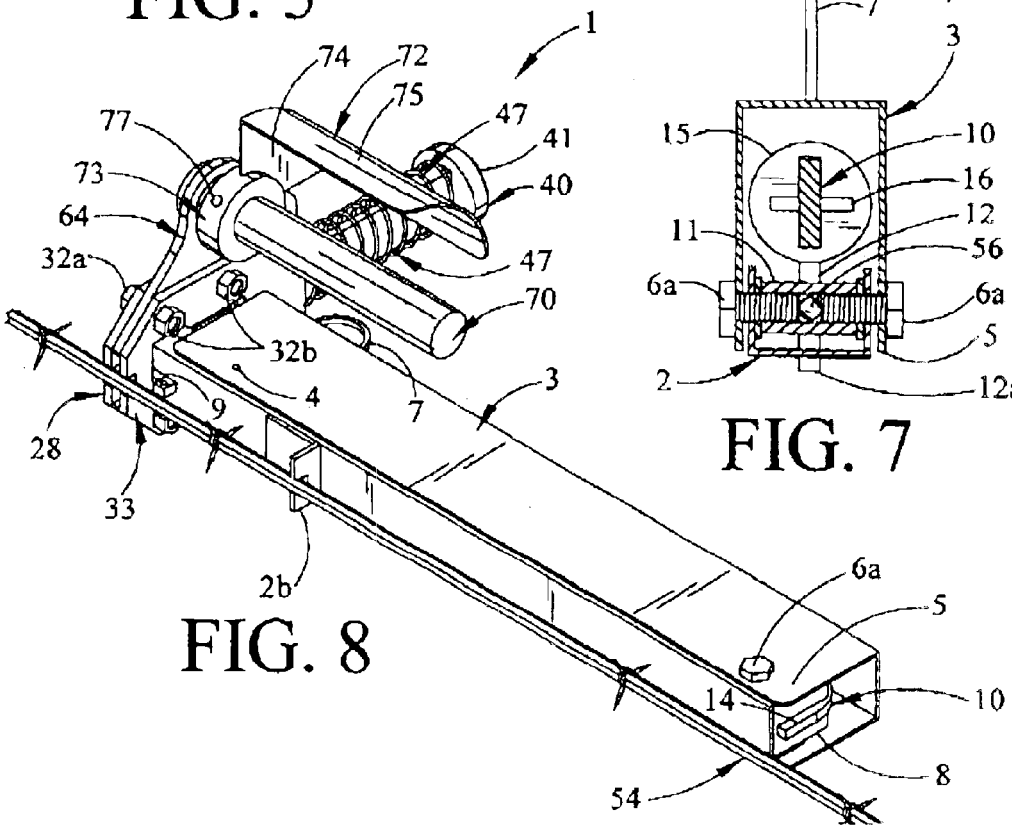
FIG. 8 is a bottom perspective view of the stapling apparatus engaging a strip of wire to be stapled to the post illustrated in FIGS. 1, 5 and 6 of the drawings.

Referring now to FIGS. 1, 5, 6, 12 and 15 of the drawings a plunger 40 is provided with a plunger anvil 41 for striking with a hammer 55 and a thick plunger neck 42 extends downwardly from the plunger anvil 41 (FIG. 15). A plunger rib or guide 43 extends downwardly from the plunger neck 42 and is upward-standing along its length from a flat staple drive plate 45, also extending from the plunger neck 42, for slidably engaging the front head slot 31 of the front head 28. The bottom end of the staple drive plate 45 is shaped to define a drive plate radius 46 for substantially matching and sequentially engaging the rounded top of each of the staples 23 and driving the staples 23 individually from the staple staging space 51 between the front head 28 and the back head 33, as hereinafter further described. A guide roll pin 44 is seated in a corresponding guide roll pin opening 44*a* (FIG. 15) in the plunger guide 43 and the staple drive plate 45, and extends through the back head slot 36 to retain the plunger 40 in drive position with respect to the front head 28 and the back head 33. A plunger spring 47 is disposed between the top corresponding edges of the front head 28 and the back head 33 and the top edge of a plunger retainer 48, seated between the front head 28 and the back head 33 and secured in place by means of the top head mount bolts 32*a*, extending through corresponding plunger retainer mount openings 49 and the aligned top two of the front head mount openings 32 and back head mount openings 38. A plunger retainer flange 50 projects upwardly from the plunger retainer 48 and engages the plunger guide 43. This mechanical arrangement stabilizes the plunger 40 in sliding operation, with the drive plate radius 46 extending into the staple staging space 51 between the front head 28 and the back head 33. Accordingly, it will be appreciated from a consideration of FIGS. 5 and 6 of the drawings that the projecting end of the staple drive plate 45 having the drive plate radius 46, extends into the staple staging space 51 defined by the front head 28, the back head 33, the outside staple gauge spacer 60 and the inside staple gauge spacer 64, to engage the respectively staged staples 23 as they are sequentially fed into the staple staging space 51 by the bias in the follower spring 19, located in the staple magazine 2. Accordingly, striking of the hammer 55 on the plunger anvil 41 of the plunger 40 causes the plunger 40 to move with respect to the front head 28 and back head 33 against the bias of the plunger spring 47, and the staple drive plate 45 to engage the staged staple 23 at the drive plate radius 46 as the staple drive plate 45 enters the staple staging space 51 and forces the staple 23 from the staple staging space 51 into a fence post 53 or board to secure a fence wire 54 or other element in place on the fence post or board. (FIGS. 1, 5 and 6).

Figure 9:
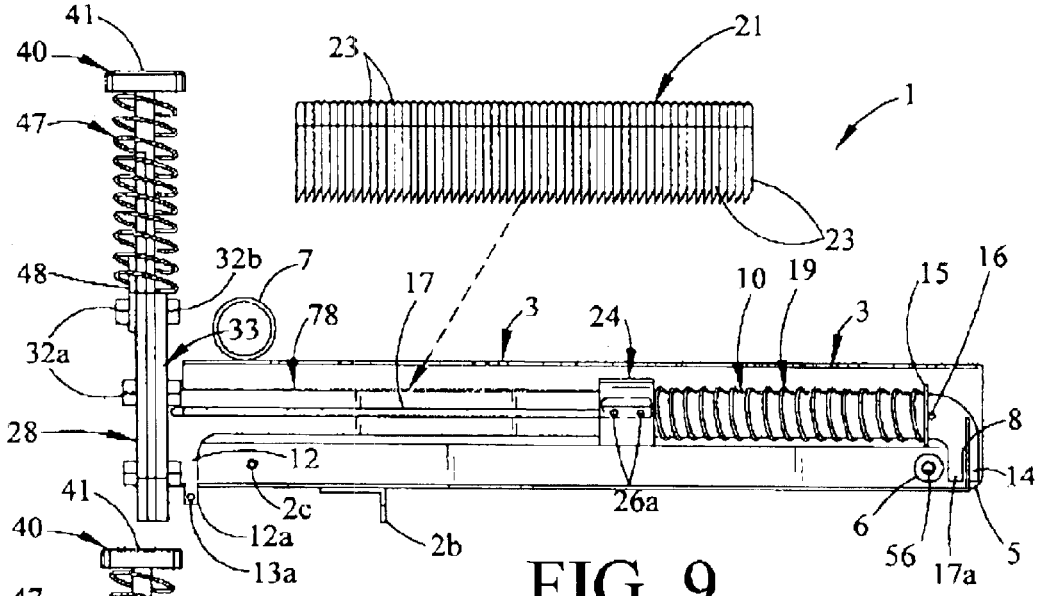
FIG. 9 is a sectional view taken along line 10—10 of the stapling apparatus illustrated in FIG. 2, more particularly illustrating the follower in cocked position against the bias of the follower spring to facilitate loading a string or cartridge of staples in the staple magazine without the use of a staple spacer.
Figure 10:
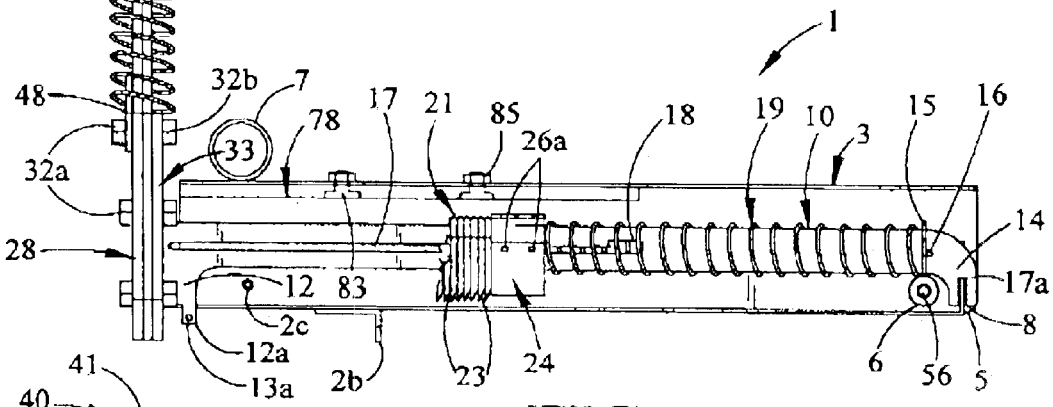
FIG. 10 is a sectional view taken along line 10—10 of the stapling apparatus illustrated in FIG. 2, more particularly illustrating the released position of the follower for pressing the staple string or cartridge forwardly into staple driving configuration under the bias of the follower spring.
Figure 11:
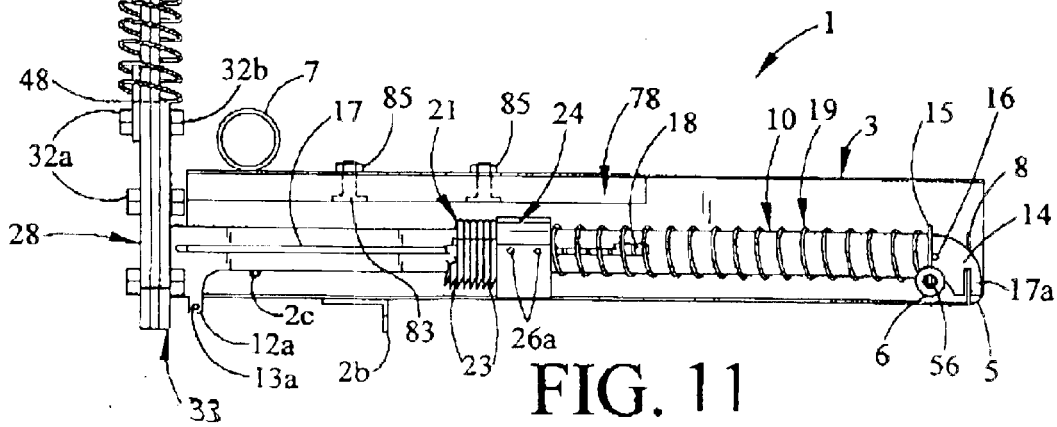
FIG. 11 is a sectional view taken along line 10—10 of the stapling apparatus illustrated in FIG. 2, more particularly illustrating mounting of a thicker spacer inside the magazine cover for accommodating smaller staples in the staple magazine.

Referring again to FIGS. 9–12 of the drawings, under circumstances where it is desired to use one of the respective first staple rail 10, second staple rail 20 or the third staple rail 22 to accommodate staples of different length and diameter, it is also necessary to utilize corresponding spacers 78 to augment this purpose. As illustrated in FIG. 12, the respective spacers 78 are bar-shaped and are each constructed of a different thickness that is proportional to the lengths of the respective front rail legs 12 and rear rail legs 14 of the matching first staple rail 10, second staple rail 20 and third staple rail 22. The spacers 78 are each typically characterized by cap screw seats (not illustrated) that accommodate cap screws 83 (FIGS. 10 and 11), which extend through corresponding cap screw openings 79 in the spacers 78 (FIG. 12) and spacer mount openings 3*a* in the magazine cover 3. Cap screw nuts 85 are then threaded on the projecting ends of the cap screws 83 to removably mount the respective spacers 78 on the inside of the magazine cover 3 and accommodate and stabilize staples 23 of varying diameter. Accordingly, each spacer 78 creates a distinctive, narrow space between the top of the respective staples 23 and the bottom of the corresponding spacer 78, to facilitate movement of the respective staples 23 along the corresponding first staple rail 10, second staple rail 20 or the third staple rail 22, as the case may be, without jamming of the staples 23. As illustrated in FIG. 9, no spacer 78 is needed where the first staple rail 10 receives a set of staples 23 or a staple cartridge 21 of such size that the magazine cover 3 serves to properly guide the staples 23 along the first staple rail 10.

In detailed operation, to load a staple cartridge 21 of glued-together staples 23, or a string of staples 23 in the staple magazine 21, the closed magazine cover 3 is initially pivoted outwardly on the cover hinge bolt 6 by grasping the cover ring 7 and disengaging the cover dimples 4 from the corresponding dimple seats 2*c*. A first staple rail 10, second staple rail 20 or third staple rail 22 and, if necessary, a correspondingly sized spacer 78, are then loaded in the staple magazine 2 and on the magazine cover 3, as heretofore described, to accommodate staples 23 of selected size, depending upon the length and diameter of the staples 23 to be loaded. When the appropriate first staple rail 10, second staple rail 20 or third staple rail 22 and the corresponding spacer 78 have been mounted on the staple magazine 2 and on the inside of the magazine cover 3, respectively, as described herein, the follower 24 is forced rearwardly along the staple rail toward the spring retainer 15 against the bias of the follower spring 19, to engage one of the follower roll pins 26*a* of the follower 24 with the enlargement shoulder 18*a* of the slot enlargement 18, as further described herein. Accordingly, that portion of the first staple rail 10, second staple rail 20 or the third staple rail 22 extending between the follower 24 and the back head 33 is exposed for the loading the staples 23 on the first staple rail 10, second staple rail 20 or the third staple rail 22, preferably in a staple cartridge 21, where the staples 23 are glued together for easy loading and optimum feeding through the hammer-operated stapling apparatus 1 by operation of the bias in the follower spring 19. When the staples 23 are thus loaded in the staple magazine 2, the follower roll pin 26*a* in the follower 24 is disengaged from the enlargement shoulder 18*a* of the slot enlargement 18, to apply the full bias and tension in the follower spring 19 against the staple cartridge 21 in the staple magazine 2. The magazine cover 3 is then pivoted on the cover hinge bolts 6*a* to again engage the oppositely-disposed cover dimples 4 in the magazine cover 3 with the corresponding dimple seats 2*c* in the staple magazine 2, and secure the magazine cover 3 on the staple magazine 2.

Referring now to FIGS. 1, 5, 6 and 8 of the drawings, the hammer-operated stapling apparatus 1 is then used by grasping the handle 70 with one hand, such that the hand is located beneath the guard plate 75 of the hand guard 72 and positioning the respective spaced-apart front head notch 30 of the front head 20*a* and the back head notch 35 of the back head 33 over a fence wire 54 or other element to be stapled to an underlying fence post 53, a board or the like. A hammer 55, typically a two-pound shop or engineer's hammer, is then used to strike the plunger anvil 41 of the plunger 40 and cause the staple drive plate 45 to slide into the staple staging space 51 toward the first staple 23 loaded in the staple magazine 2 and project into the staple staging space 51. Continued movement of the plunger 40 moves the staple drive plate 45 downwardly, compresses the plunger spring 47 and the drive plate radius 46 contacts the curved top portion or head of the first staged staple 23 and drives the staple 23 away from the adjacent staple 23 and from the staple staging space 51 between front head 28 and the back head 33, into the underlying fence post 53 to mount or seat the fence wire 54 to the fence post 53 (FIGS. 1 and 2). The compressed plunger spring 47 then operates to extend or retract the plunger in the opposite direction, back to its original starting position as illustrated in FIG. 5, while the follower spring 19 operates to slide the staples 23 forwardly on the first staple rail 10 and seat and stage the next staple 23 in the staple staging space 51. The front head notch 30 and back head notch 35 are then repositioned, the plunger anvil 41 again struck with the hammer 55 and the plunger 40 again operates to drive the second staple from the front head 28 and the back head 33 into the post or board, as described above. The process is repeated until the supply of staples 23 in the staple magazine 2 is exhausted, after which time additional staples 23 may be loaded into the staple magazine 2 and seated on the corresponding first staple rail 10, second staple rail 20 or third staple rail 22, as deemed necessary and as heretofore described.

Under circumstances where it is desired to change the first staple rail 10, second staple rail 20 or the third staple rail 22, the anchor roll pin 13*a*, seated in the roll pin opening 13 in the front rail leg 12 of the currently installed staple rail is driven from its position in the roll pin opening 13 to free the front rail leg 12 from the anchor opening 9 located in the bottom of the staple magazine 2, as illustrated in FIGS. 9–12. The installed staple rail may then be removed from the staple magazine 2 by disengaging the rear rail leg 14 from the upward-standing staple rail anchor 8. The follower 24 can then be removed from the loosened staple rail by driving the two follower roll pins 26*a* from the follower roll pin openings 26 and lifting the follower 24 from the staple rail. The follower spring 19 and the spring retainer 15 can then be removed from the staple rail by slipping these elements over the corresponding front rail leg 12. A second staple rail can then be positioned in the staple magazine 2 by reversing the procedure outlined above. Furthermore, the respective spacers 78 which correspond to the first staple rail 10, second staple rail 20 or the third staple rail 22 are easily removed and replaced by unthreading the corresponding cap screw nuts 85 and removing the cap screws 83 to facilitate detachment of each spacer 78 from the interior of the magazine cover 3. Replacement by a second spacer 78 that corresponds to the selected size of the staples 23 and the corresponding first staple rail 10, second staple rail 20 or third staple rail 22 selected for installation in the staple magazine 2, is then effected by reversing this procedure.

Figure 14:
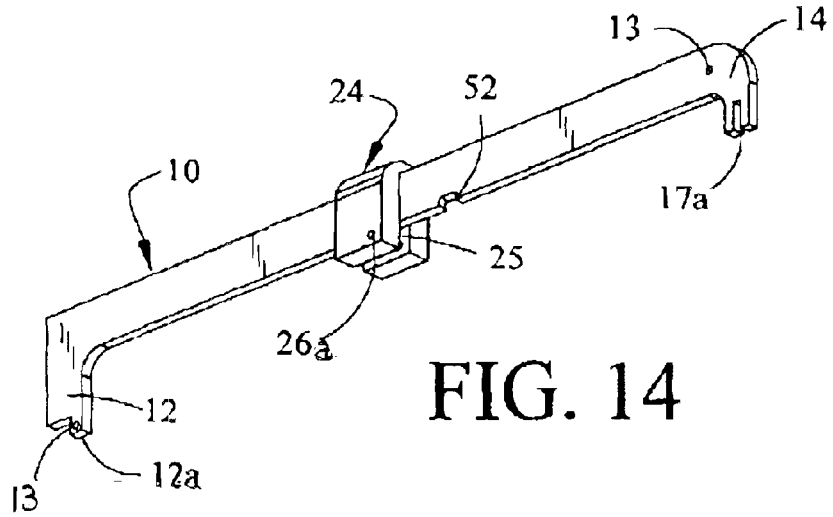
FIG. 14 is a perspective view of a staple rail and follower of alternative design.

Referring now to FIG. 14 of the drawings, in an alternative embodiment of the invention the first staple rail 10, second staple rail 20 and third staple rail 22 are each characterized by an indentation 52 that receives a single follower roll pin 26*a* in the follower 24 to effect loading of the staples 23 according to the procedure outlined above.

It will be appreciated by those skilled in the art that the hammer-operated stapling apparatus of this invention is characterized by ruggedness, stability and ease of use, with a high degree of safety, for reliably and rapidly driving a supply of staples of selected size sequentially into fence posts, boards and the like to secure wire such as barbed wire and the like, in place. The hammer-operated stapling apparatus is convenient, safe and easy to use and greatly simplifies and speeds the process of driving staples into posts and boards by virtue of its portability and utility. Furthermore, the device is versatile, in that it can accommodate staples of varying length and diameter, three sizes of which are illustrated herein for purposes of illustration only, by utilizing a selected staple rail and corresponding spacer to accommodate these staples. Accordingly, it will be appreciated that the hammer-operated stapling apparatus can be designed for accommodating a single staple rail without the need for a spacer, or for multiple staple rails with corresponding spacers, as described above, according to the desires of the user. Additional versatility is provided by the capability of reversing the position of the handle 70 by reversing the positions of the inside staple gauge spacer 64 and the outside staple gauge spacer 60, such that the handle 70 projects rearwardly from the opposite side of the magazine cover from the position illustrated in FIG. 2 of the drawings. This reversal is effected by removing the respective nuts 32*b* and head mount bolts 32*a*, reassembling the front head 28, back head 33 and the inside staple gauge spacer 64 and outside staple gauge spacer 60 in reverse order and reattaching the handle 70 to the hand guard shaft collar 73, as described herein.

While the preferred embodiments of the invention have been described above, it will be recognized and understood that various modifications may be made in the appended claims and the appended claims are intended to cover all such modifications which may fall within the spirit and scope of the invention.

Having described my invention with the particularity set forth above, what is claimed is:

1. A hammer-operated stapling apparatus for driving staples of selected size glued together in a staple cartridge, comprising a magazine; a staple rail mounted in said magazine for supporting the staple cartridge; a magazine cover pivotally carried by said magazine for enclosing the staple cartridge on said staple rail; a follower slidably mounted on said staple rail for contacting one end of the staple cartridge; a spring-engaging said follower for biasing said follower against the staple cartridge; a head apparatus provided on one end of said magazine for receiving the staples in the staple cartridge in sequence; a plunger reciprocally mounted in said head apparatus for contacting the staples in said head apparatus and driving the staples in sequence from said head apparatus responsive to a force applied to said plunger; and a handle reversibly carried by said head apparatus for positioning said head apparatus while driving the staples from said head apparatus.

2. The hammer-operated stapling apparatus of claim 1 wherein said head apparatus comprises a back head carried by said magazine for receiving the staples in sequence; a front head spaced from said back head; and a pair of spaced-apart staple gauge spacers interposed between said back head and said front head to define a staple staging space for receiving said plunger and accommodating the staples in sequence prior to application of said force to said plunger.

3. The hammer-operated stapling apparatus of claim 2 wherein said staple rail is removably mounted in said magazine and comprising a spacer removably provided on said magazine cover and spaced from said staples for stabilizing the staples on said staple rail.

4. The hammer-operated stapling apparatus of claim 1 comprising a hand guard provided on said handle for shielding the hand from said force applied to said plunger.

* * * * *